US006170555B1

(12) United States Patent
Welfonder

(10) Patent No.: US 6,170,555 B1
(45) Date of Patent: Jan. 9, 2001

(54) CORNER ASSEMBLY FOR A FRAME

(75) Inventor: Konrad Welfonder, Bremerhaven (DE)

(73) Assignee: Hunter Douglas Industries BV, EL Rotterdam (NL)

( * ) Notice: Under 35 U.S.C. 154(b), the term of this patent shall be extended for 0 days.

(21) Appl. No.: 09/265,500

(22) Filed: Mar. 10, 1999

(30) Foreign Application Priority Data

Mar. 11, 1998 (EP) ..... 98200762

(51) Int. Cl.[7] ..... A47G 5/00; E06B 3/30; E06B 9/24

(52) U.S. Cl. ..... 160/381; 160/375

(58) Field of Search ..... 160/381, 369, 160/106, 90, 375, 376, 377, 371; 52/213, 202, 656.1, 204.1; 49/57, 50, 62, 465; 403/401, 402, 403, 61

(56) References Cited

U.S. PATENT DOCUMENTS

| | | | | |
|---|---|---|---|---|
| 1,765,388 | | 6/1930 | Watson . | |
| 2,772,451 | * | 12/1956 | Luke | 160/376 X |
| 3,137,901 | * | 6/1964 | Malachowski et al. | 160/369 X |
| 3,709,533 | * | 1/1973 | Walters | 160/381 X |
| 4,006,513 | | 2/1977 | Offterdinger . | |
| 4,502,260 | * | 3/1985 | Machler | 160/381 X |
| 4,574,506 | * | 3/1986 | Morgan | 160/381 X |
| 5,119,872 | * | 6/1992 | Engebretson | 160/381 |
| 5,297,891 | * | 3/1994 | Rosa | 160/381 X |
| 5,431,211 | * | 7/1995 | Guillemet | 160/381 |

FOREIGN PATENT DOCUMENTS 0628694 12/1994 (EP) .

* cited by examiner

*Primary Examiner*—Jerry Redman
*Assistant Examiner*—Hugh B. Thompson
(74) *Attorney, Agent, or Firm*—Dorsey & Whitney LLP

(57) ABSTRACT

A nodal assembly for connecting at least two adjacent frame members of a perimeter frame, the nodal assembly comprising a central portion having parallel first and second sides and an opening in the second side, a first leg extending from the central portion in a first direction parallel to the first side and having a cavity within it in communication with the opening, a second leg extending from the central portion in a second direction different from the first direction but also parallel to the first side, and a retainer slidably received in the cavity and movable between a retracted position substantially within the central portion and the first leg and an extended position in which the retainer extends substantially outwardly of the opening in the second side of the central portion and away from the second side.

28 Claims, 7 Drawing Sheets

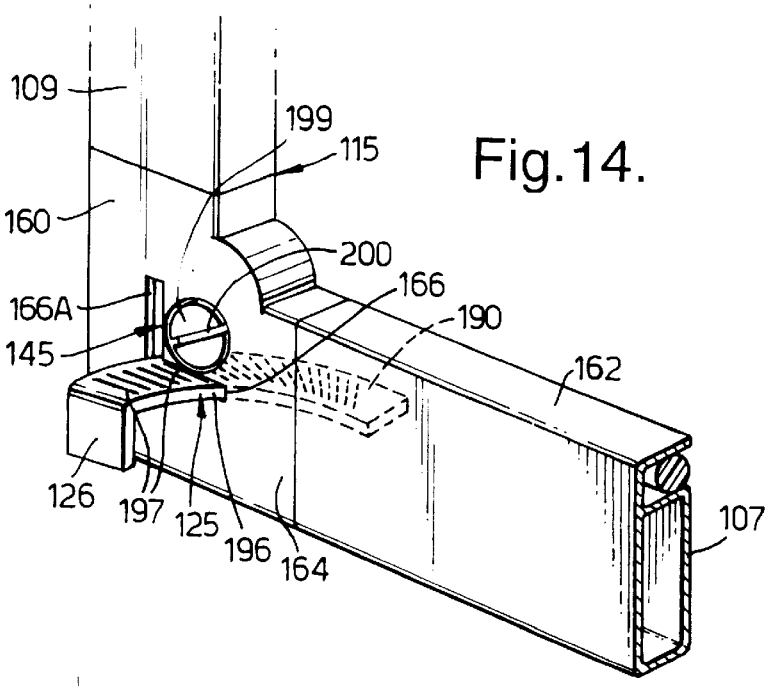
Fig.14.
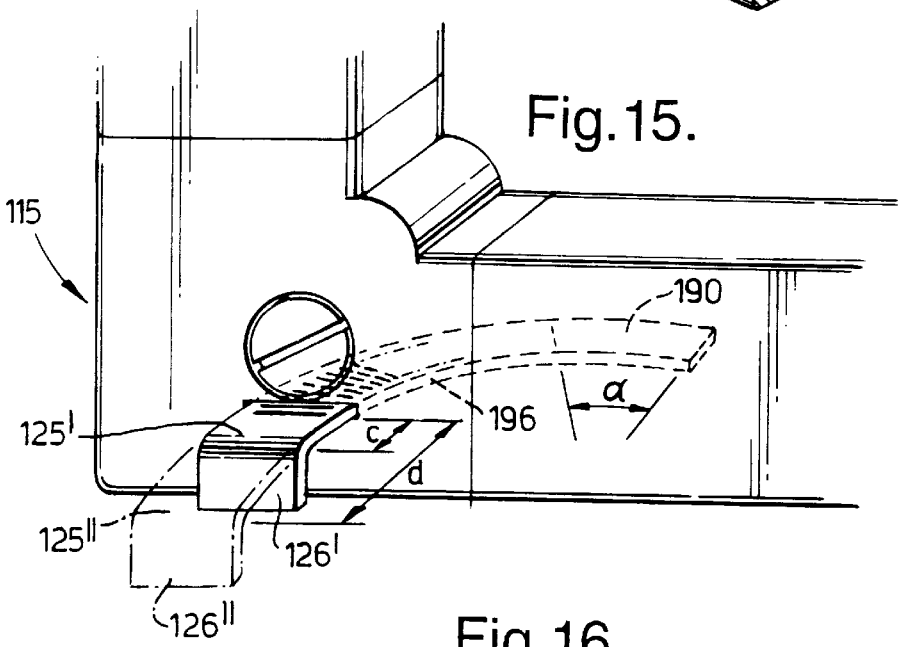
Fig.15.
Fig.16.
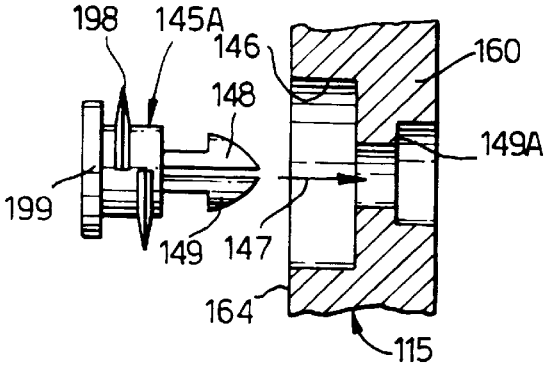

CORNER ASSEMBLY FOR A FRAME

CROSS-REFERENCE TO RELATED APPLICATION

This application corresponds to and claims priority to European Application No. 98200762.7, filed 11 Mar. 1998. This European application is hereby incorporated by reference as though fully set forth herein.

This invention relates to a nodal assembly, particularly a corner assembly, for a peripheral frame which can be removably mounted on an architectural opening. This invention quite particularly relates to a corner assembly for the frame of an insect screen for a window opening.

Corner assemblies of frames that can be used to removably mount framed insect screens and other sheet-line panels on windows and doors are known, for example, from U.S. Pat. No. 5,431,211 and UK patent application GB 2,236, 134A. U.S. Pat. No. 5,431,211, in particular, describes an insect screen that has a frame with a corner assembly having a retaining protrusion which is: i) slidably held within the corner assembly and ii) can be slid outwardly of a longitudinal side of the corner assembly and into a suitable recess provided in the window frame to hold the screen on the window. However, the windows and doors, to which such a corner assembly has been attached, have had to be specially provided with suitable recesses which could accept and hold the retaining protrusion of the corner assembly.

In accordance with this invention, a nodal assembly, particularly a corner assembly, is provided for connecting at least two adjacent frame members of a perimeter frame, the nodal element comprising:

- a central portion having parallel first and second sides and an opening in the second side;
- a first leg extending from the central portion in a first direction parallel to the first side and having a cavity within it in communication with the opening;
- a second leg extending from the central portion in a second direction different from the first direction but also parallel to the first side; and
- a retainer slidably received in the cavity and movable between a retracted position substantially within the central portion and the first leg and an extended position in which the retainer extends substantially outwardly of the opening in the second side of the central portion and away from the second side.

In accordance with one aspect of the nodal assembly of the invention: the first and second sides of the central portion are laterally opposite sides, preferably front and rear sides; the cavity in the first leg is substantially parallel to the first leg; one end of the cavity is in communication with one end of a channel in the central portion; and the other end of the channel is in communication with the opening in the central portion.

In accordance with another aspect of the nodal assembly of the invention: the retainer comprises:

- an elongated part at one end, preferably a front end part, which is slidably received in the cavity in the first leg and in the channel, if present, and which can be moved outwardly, preferably rearwardly, of the second side of the central portion through the opening in the second side; and
- a hook-shaped part at its other end, preferably a rear end part, which is located outwardly, preferably rearwardly, of the second side of the central portion; the retainer, in its retracted position, having a central part substantially within the cavity in the first leg and in its extended position, having its central part extending outwardly of the cavity through the opening in the central portion and away from, preferably rearwardly of, the second side of the central portion.

Also in accordance with this invention, a perimeter frame is provided comprising:

- a plurality of elongate frame members;
- a plurality of the nodal assemblies described above, each nodal assembly having first and second legs engaging the ends of two adjacent frame members to form the perimeter frame and a retainer; and optionally
- a sheet-like panel attached to the perimeter frame to cover an area defined by the perimeter frame; each of the retainers being adapted to engage a window opening having a contour corresponding to the perimeter frame so that the sheet-like panel, if present, covers the window opening.

Further aspects of the invention will be apparent from the detailed description below of particular embodiments and the drawings thereof.

FIG. 7 shows the final mounted position of the perimeter frame on the window frame.

FIG. 14 is an enlarged schematic detail view, similar to FIG. 8 and 9, of another embodiment of a corner assembly of this invention, shown as a left-hand bottom corner detail of a perimeter frame.

FIG. 15 is a schematic top plan view of the corner assembly of FIG. 14.

FIG. 16 is a schematic partial vertical cross-sectional view through the corner assembly of FIG. 14, showing an exploded arrangement of an adjusting device.

Figure 17:
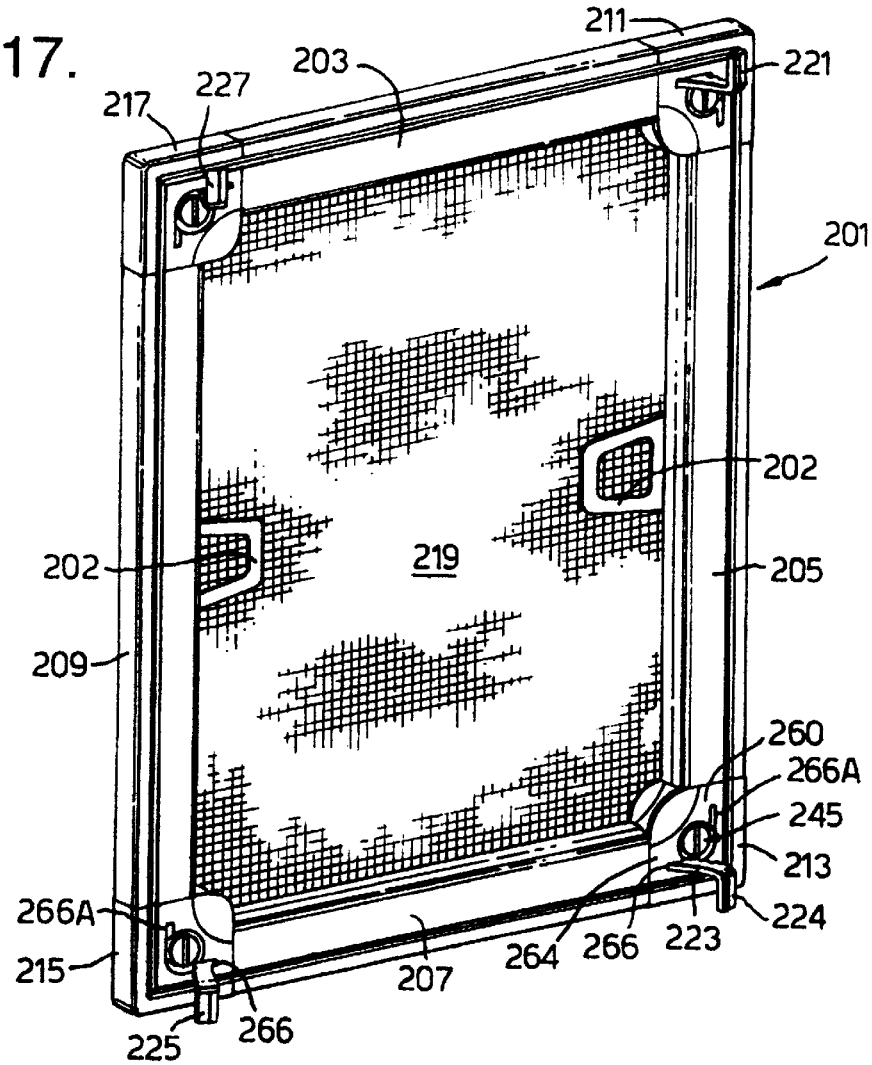
FIG. 17 is a perspective view, similar to FIG. 1, of the rear of a perimeter frame for a sheet-like panel having four further embodiments of a corner assembly of this invention.
Figure 18:
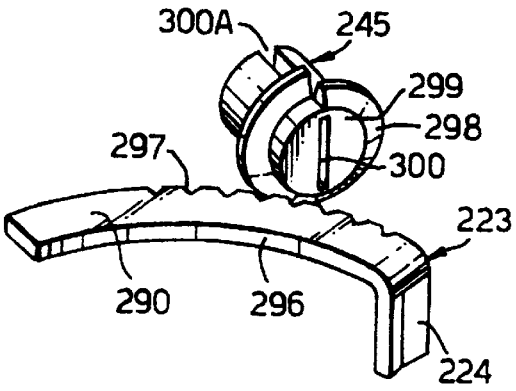

FIG. 18 a schematic perspective view of components of a corner assembly of FIG. 17 in their operative positions but free from the surrounding structure of the corner assembly.

Figure 19:
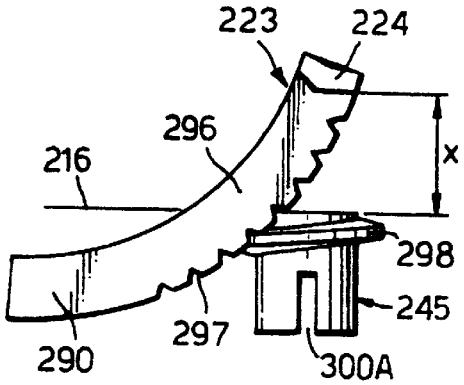

FIG. 19 is a schematic bottom view of the components of FIG. 18. In these Figures, corresponding parts in different embodiments are referred to by the same name and by the same last two reference numerals.

FIGS. 1–13 schematically show one embodiment of a rectangular perimeter frame, generally 1, of this invention for an architectural opening, such as a window.

Figure 1:
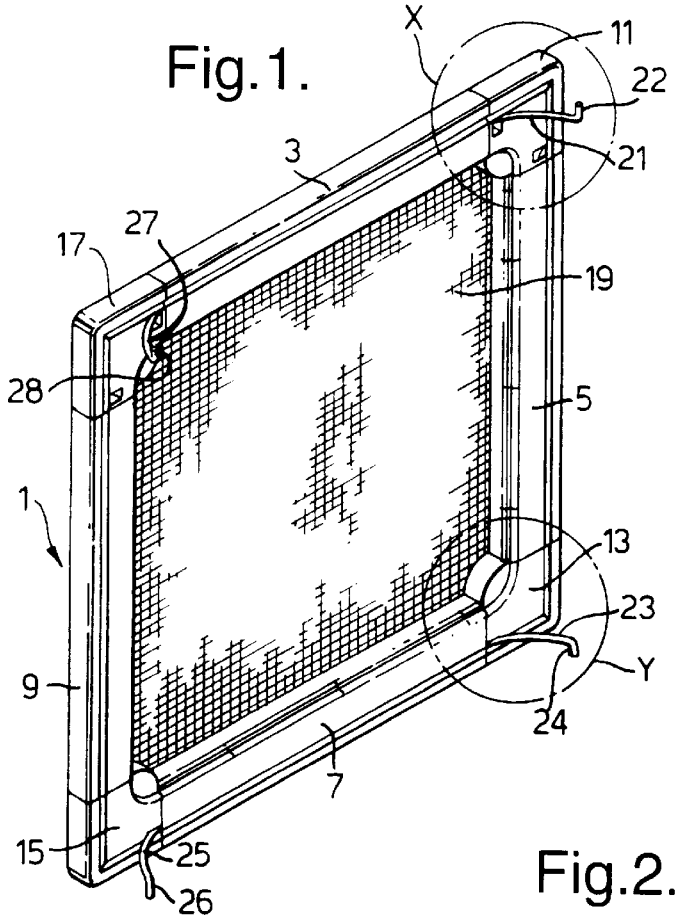
FIG. 1 is a perspective view of the rear of one embodiment of a perimeter frame for a sheet-like panel, having g four corner assemblies of this invention.

As best seen in FIG. 1, the perimeter frame 1 comprises first, second, third and fourth elongate frame members 3, 5, 7 and 9, the e ends of which are committed to each other by first, second, third and fourth, nodal or corner assemblies 11, 13, 15 and 17, respectively, of this invention. A sheet-like panel member 19, such as an insect screen, is attached in a conventional manner to the frame members 3, 5, 7 and 9 to cover an area surrounded by the perimeter frame 1. Extending from the rear of each corner assembly 11, 13, 15 and 17 is a hook-shaped retainer 21, 23, 25 and 27, respectively, each having a hook-shaped first end part 22, 24, 26 and 28, respectively, which will be described below in relation to FIGS. 8–13.

Figure 2:
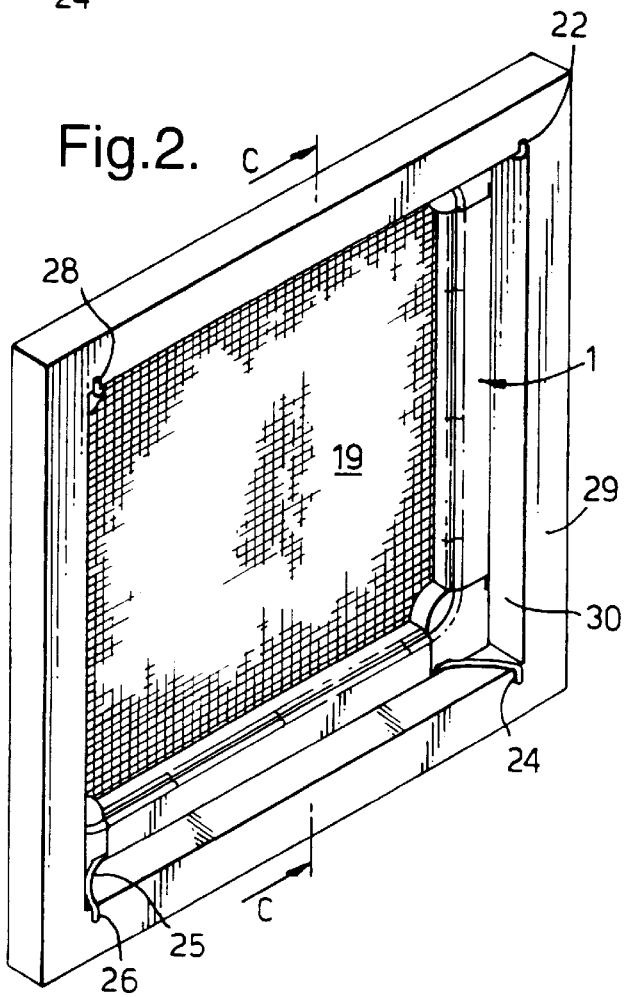
FIG. 2 is a perspective view of the rear of a window frame or jamb having an opening in which the perimeter frame of FIG. 1 is installed.

As seen in FIG. 2, when the perimeter frame 1 is installed in a window frame, generally 29, the hook-shaped first end parts 22, 24, 26 and 28 of the retainers 21, 23, 25 and 27 engage the adjacent rear sides of the widow frame 29 to hold the perimeter frame and its sheet-like panel 19 in place over the window opening 30.

Figure 3:
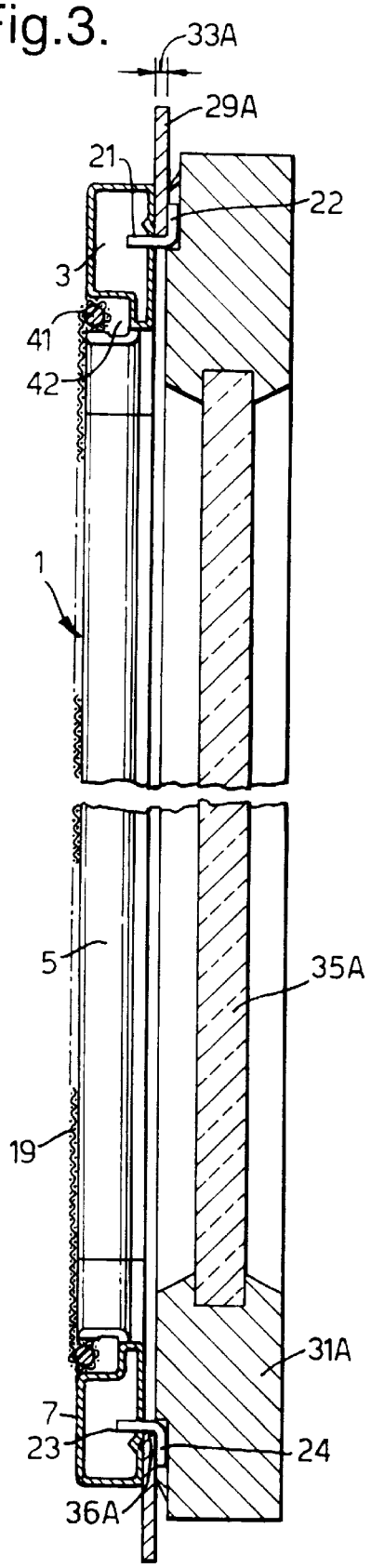
FIG. 3 is a schematic cross-sectional view of the perimeter frame of FIGS. 1 and 2 installed on a first embodiment of a window frame similar to that in FIG. 2, taken along line C—C of FIG. 2.

FIG. 3 shows a first type of window frame 29A hingedly carrying a pane frame 31A. The window frame 29A has only a shallow thickness 33A which is common to metal window frames. The hinged pane frame 31A can be made of metal, wood or plastic and contains a glass pane 35A. The rear sides of the frame member 3, 5, 7 and 9 (9 not shown in FIG. 3) of the perimeter frame 1 of this invention and its corner assemblies 11, 13, 15 and 17 rest against the front of the window frame 29A, with the hook-shaped end parts 22, 24, 26 and 28 (26 and 28 not shown in FIG. 3) of the retainers 21, 23, 25 and 27 (25 and 27 not shown in FIG. 3) of the corner assemblies engaging adjacent rear sides of the widow frame 29A to hold the perimeter frame and its sheet-like panel 19 in place over the window opening 30 and also over the glass pane 35A when the hinged frame 31A is closed.

As seen in FIGS. 2 and 3, the hook-shaped end part 22, 24, 26 and 28 of each retainer 21, 23, 25 and 27 need only extend rearwardly from the perimeter frame 1 and its corner assembly 11, 13, 15 and 17 by the rearward thickness 33A of the adjacent inner facing side 36A of the FIG. 3-type window frame 29A. If the retainers 21, 23, 25 and 27 have sufficiently thin hook-shaped end parts 22, 24, 26 and 28, as is shown in FIG. 3, they do not interfere with the closure of the pane frame 31A. With this arrangement, the sheet-like panel 19 in the perimeter frame 1 can remain in position when the pane frame 31A is closed.

Figure 4:
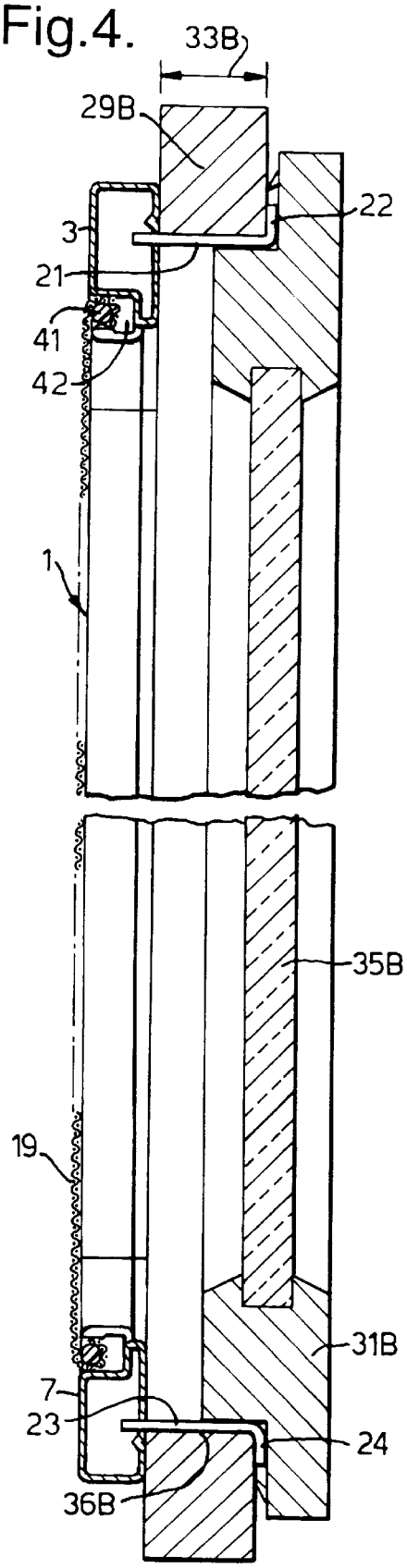
FIG. 4 is a schematic cross-sectional view of the perimeter frame of FIGS. 1 and 2 installed on a second embodiment of a window frame similar to that in FIG. 2, taken along line C—C of FIG. 2.

FIG. 4 shows a second type of window frame 29B hingedly carrying a pane frame 31B that contains a glass pane 35B. The window frame 29B has a larger thickness 33B than does the window frame 29A of FIG. 3. The window frame 29B can be made of wood or plastic, and the hinged pane frame 31B can be made of metal, wood or plastic. The rear sides of the frame members 3, 5, 7 and 9 (9 not shown in FIG. 3) of the perimeter frame 1 of this invention and its corner assemblies 11, 13, 15 and 17 rest against the front of the window frame 29B, with the hook-shaped end parts 22, 24, 26 and 28 (26 and 28 not shown in FIG. 4) of the retainer hooks 21, 23, 25 and 27 (25 and 27 not shown in FIG. 4) of the corner assemblies engaging adjacent rear sides of the widow frame 29B to hold the perimeter frame and its sheet-like panel 19 in place over the window opening 30 and over the glass pane 35B if it is closed.

As seen in FIG. 4, the hook-shaped end parts 22, 24, 26 and 28 of the retainer hooks 21, 23, 25 and 27 extend rearwardly from the perimeter frame 1 and its corner assemblies 11, 13, 15 and 17 by the substantial rearward thickness 33B of the respective adjacent inner facing sides 36B of the FIG. 4-type window frame 29A. Thus, the retainers 21, 23, 25 and 27 and the corner assemblies 11, 13, 15 and 17 are preferably constructed in accordance with this invention to hold the perimeter frame 1 in place on the relatively thick window frame 31B of FIG. 4, as well as the relatively thin window frame 31A of FIG. 3. If the retainers 21, 23, 25 and 27 have sufficiently thin hookshaped end parts 22, 24, 26 and 28, as is shown in FIG. 4, they do not interfere with the closure of the pane frame 31B. With this arrangement, the sheet-like panel 19 in the perimeter frame 1 can remain in position when the pane frame 31B is closed.

As will be appreciated from the above, the perimeter frame may conveniently be hung on the outside of an inwardly opening window or on the inside of an outwardly opening window.

The retainers 21, 23, 25 and 27 are preferably made from a relatively strong and durable metal or plastic, especially steel, particularly a conventional spring steel. The upper retainers 21 and 27 can, if desired, be made from a somewhat more flexible material than the lower retainers 23 and 25. However, for ease of stocking retainers 21–27, it may be preferable to use identical upper retainers 21 and 27 and lower retainers 23 and 25 in the perimeter frame 1.

As also shown in FIGS. 3 and 4, a spline 41 is preferably provided in a groove 42 formed in the inner facing side of each of the frame members 3, 5, 7 and 9 to hold the sheet-like panel 19 in the perimeter frame 1 of this invention.

Figure 5:
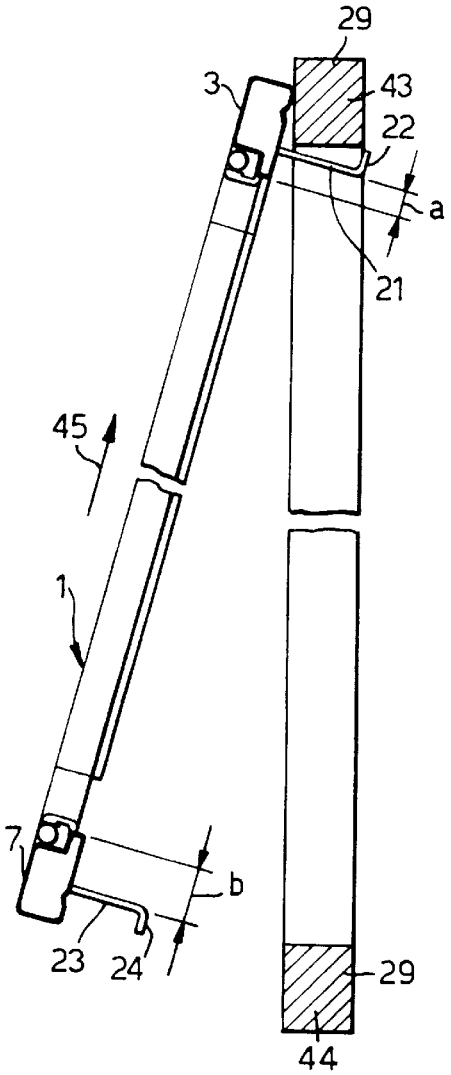
FIGS. 5, 6 and 7 are schematic cross. sectional views of several steps in the process of installing the perimeter frame on the window frame of FIG. 2, taken along line C—C of FIG. 2.
Figure 6:
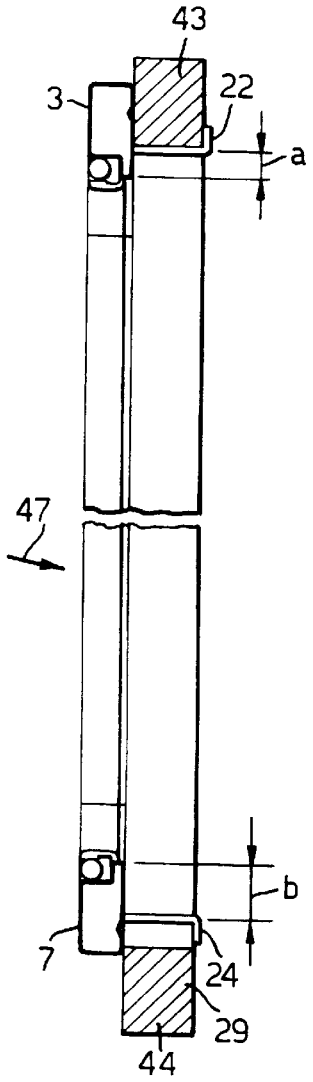
Figure 7:
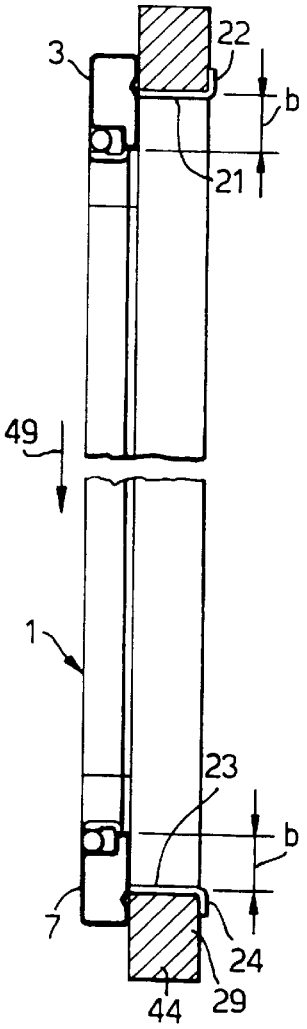

FIGS. 5, 6 and 7 show the steps for installing the perimeter frame 1 in a window frame 29. Initially, the upper retainers 21 and 27 (27 not shown in FIGS. 5–7), with their upwardly extending, hook-shaped end parts 22 and 28, are pulled outwardly of their respective upper corner assemblies 11 and 17by a distance corresponding to the thickness of the frame 29. The upper retainers 21 and 27 are then urged against the upper jamb 43 of the window opening 29 and deflected downwardly to a distance "a" above the bottom of the upper horizontal frame member 3 of the perimeter frame 1 as shown in FIG. 5. This downward deflection of retainers 21 and 27 can be obtained as shown by moving the entire perimeter frame 1 upwardly in the direction of arrow 45 against the bottom of the upper jamb 43 of the window frame 29.

As shown in FIG. 6, the lower retainers 23 and 25 (25 not shown in FIGS. 5–7), with their downwardly extending, hook-shaped end parts 24 and 26, are then pulled outwardly of their respective lower corner assemblies 13 and 15 (if they have not already been so-pulled outwardly). The lower retainers 23 and 25, which are located a distance "b" below the top of the lower horizontal frame member 7 of the perimeter frame 1, are then moved over the lower jamb 44 of the window frame 29 by swinging the perimeter frame 1 rearwardly in the direction of arrow 47.

When the perimeter frame 1 is thereafter allowed to move downwardly as indicated by arrow 49 in FIG. 7, the upper retainers 21 and 27 return to their relaxed positions at a similar distance "b" above the bottom of the upper frame member 3 as the distance "b" that the lower retainers 23 and 25 are below the top of the lower frame member 7. As also seen in FIG. 7, the hooked end parts 22, 24, 26 and 28 of the retainers 21, 23, 25 and 27 thereby engage the rear surfaces of the upper and lower jambs 43 and 44 of the window frame 29 to hold the perimeter frame 1 securely in the window opening 30.

FIGS. 8–13 show details of two of the corner assemblies 11 and 13 of FIGS. 1–7. Preferably, the other two corner assemblies 15 and 17 are mirror images of the corner assemblies 11 and 13, respectively.

Figure 8:
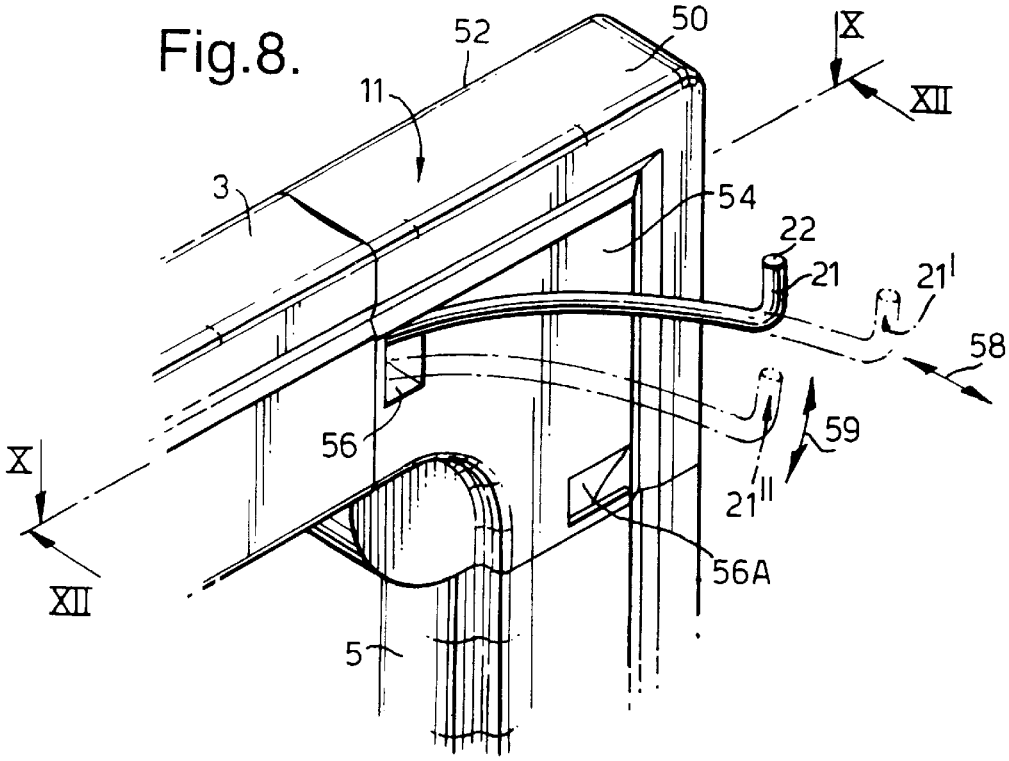
FIG. 8 is an enlarged detail view of a corner assembly "X" of FIG. 1, showing several positions of a vertically more flexible, slidable retainer in the corner assembly.

As seen in FIG. 8, the upper corner assembly 11 has a central portion 50 with parallel front and rear sides 52 and 54. A relatively large opening 56 is provided in the rear side 54 of the central portion 50, through which the relatively vertically more flexible retainer 21 extends and from which its hooked end part 22 extends rearwardly of the central portion. The distance that the retainer 21 and its hook-shaped end part 22 extend rearwardly from the central portion 50 can be varied, and one possible further position is indicated as 21' by dotted lines. In this regard, the retainer 21 can be moved, relative to the opening 56, in either direction of the double arrow 58 so that the retainer 21 extends away from the rear side 54 of the central portion 50 to greater or lesser extents.

FIG. 8 also shows the retainer 21 and its hook-shaped end part 22 being deflected downwardly to a position 21", indicated by dotted lines. Such forced deflection and the resulting resilient relaxation of the retainer 21 is generally in the vertical direction of double arrow 59. This vertical movement of the retainer 21 is accommodated by the opening 56 which is relatively large in the vertical direction and optionally by the relatively more flexible nature of the retainer 21 which is preferably made of spring steel wire.

Figure 9:
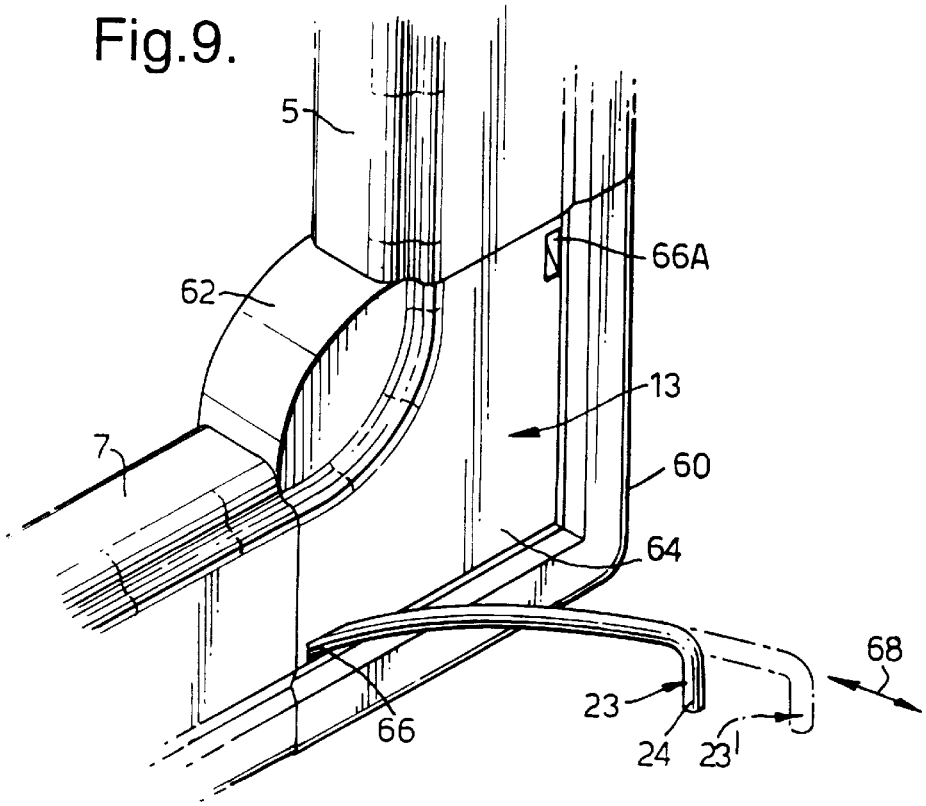
FIG. 9 is an enlarged detail view of another corner assembly "Y" of FIG. 1, showing two positions of a vertically less flexible, sidable retainer in the corner assembly.

As seen in FIG. 9, the lower corner assembly 13 also has a central portion 60 and parallel front and rear sides 62 and 64. A relatively small opening 66 is provided in the rear side 64 of the central portion 60, through which the relatively less flexible retainer 23 extends and from which its hook-shaped end part 24 extends rearwardly of the corner assembly 13. As with the upper corner assembly 11 of FIG. 8, the distance that the retainer 23 and its hook-shaped end part 24 of the lower corner assembly 13 extend rearwardly of the central portion 60 can be varied, and one possible further position is indicated as 23' by dotted lines. In this regard, the retainer 23 can be moved, relative to the opening 66, in either direction of the do able arrow 68 so that the retainer 23 extends from the rear side 64 of the central portion 60 to greater or lesser extents.

The lower corner assemblies 13 and 15 support the weight of the perimeter frame 1 and its sheet-like panel 19. For this reason, their retainers 23 and 25 preferably are not allowed to be deflected significantly upwardly by the weight of the perimeter frame 1 as shown in FIG. 9. Such limited vertical movement of the retainers 23 and 25 is obtained by providing openings 66 in the rear sides 64 of their central portions 60 that are relatively small vertically and by making the retainers 23 and 25, if necessary, relatively inflexible, preferably of spring steel wire.

FIGS. 8 and 9 also show that the rear sides 54 and 64 of the central portions 50 and 60 of the upper and lower corner assemblies 11 and 13, as well as of the other upper and lower corner assemblies 15 and 17 (not shown), are provided with an additional, unused opening 56A and 66A, respectively. As a result, each of the upper and lower retainers 21 and 23, as well as each of the other upper and lower retainers 27 and 25 (not shown), can alternatively be extended from these additional openings 56A and 66A. Thereby, the corner assemblies 11 and 13 of FIGS. 8 and 9, as well the corner assemblies 15 and 17 (not shown), can be placed in either right or left hand positions in the perimeter frame 1 of this invention. For example, by repositioning the retainers 21 and 23 to extend from openings 56A and 66A in the corner assemblies 11 and 13, the right hand corner assemblies 11 and 13 as shown in FIGS. 1–8 can also be used on the left hand side of the perimeter frame 1 as its corner assemblies 15 and 17, respectively, as shown in FIGS. 1–8. This allows a substantial reduction in the number of different components which have to be manufactured and stocked for the perimeter frame 1.

In FIGS. 1–8, first and second legs 72 and 74, extending at right angles to each other from the central portion 50 of the corner assembly 11 and parallel to the first and second sides 52 and 54, are inserted in the adjacent open ends of the frame member 3 and 5 in a conventional manner and are thereby hidden from view. Likewise, first and second legs 72 and 74 (not shown), extending at right angles to each other from the central portion 60 of the corner assembly 13 and parallel to the first and second sides 62 and 64, are inserted in the open ends of the adjacent frame member 5 and 7 in a conventional manner in FIG. 9 and are thereby hidden from view. In the same manner, first and second legs 72 and 74 (not shown), extending at right angles to each other from each central portion 50 or 60 of the each of the other corner assemblies 15 and 17, are inserted in the ends of the adjacent frame member 3, 5, 7 and 9 in a conventional manner and are thereby also hidden from view. In this regard, the corner assemblies 11, 13, 15 and 17 of this invention, including their central portions 50 and 60 and their legs 72 and 74 and their attachment to the frame members 3, 5, 7, and 9, are conventional, except for their retainers 21, 23, 25 and 27 and their interior structures, as described below, by which the retainers can be extended or retracted and their hook-shaped end parts 22, 24, 26 and 28 can be held on to an architectural opening.

Figure 10:
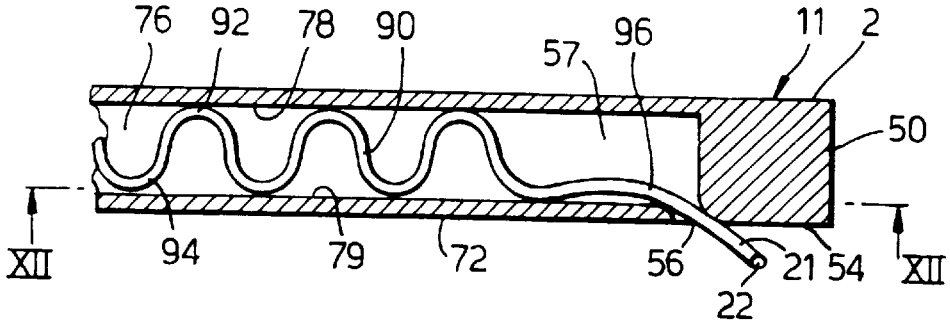
FIG. 10 is a schematic cross-sectional view in a horizontal plane, taken along line X—X in FIG. 8, with the vertically more flexible retainer in a retracted position.
Figure 11:
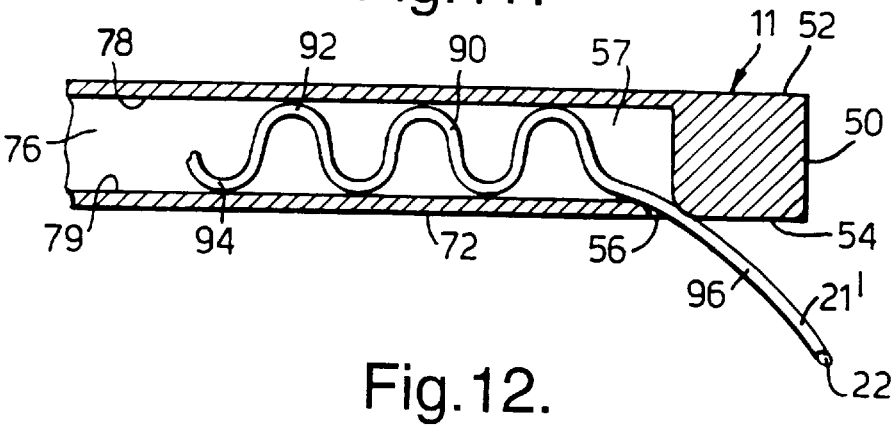
FIG. 11 is a schematic view similar to FIG. 10 with the vertically more flexible retainer in an extended position.
Figure 12:
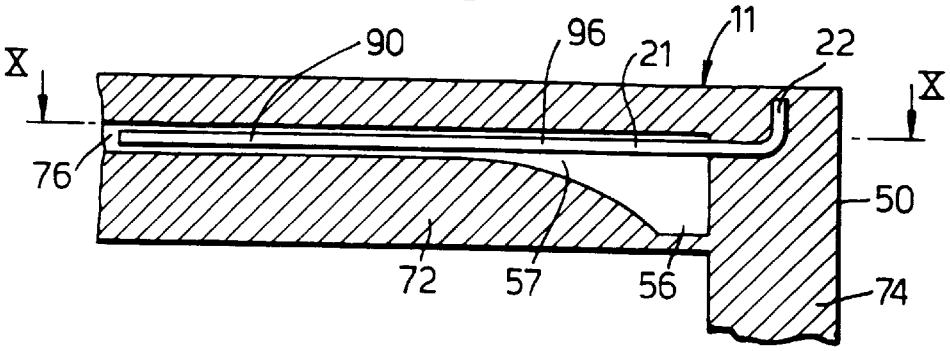
FIG. 12 is a schematic cross-sectional view in a vertical plane, taken along line XII—XII in FIGS. 8 and 10 with the vertically more flexible retainer in a non-deflected position.
Figure 13:
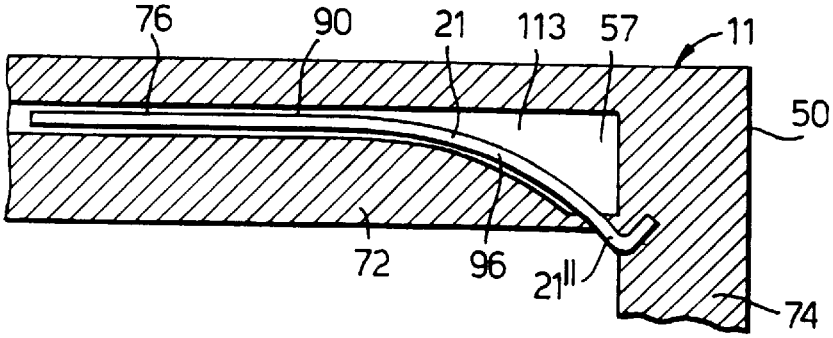
FIG. 13 is a schematic view similar to FIG. 12 with the vertically more flexible retainer in a downwardly deflected position.

FIGS. 10–13 show details of the interiors of the central portion 50 and first leg 72 of the corner assembly 11 which are typical of a central portion and a leg of at least the upper corner assemblies 11 and 17 of this invention. The first leg 72 serves, in a conventional manner, to hold the corner assembly 11 and its central portion 50 in sliding engagement with the hollow interior of an adjacent frame members (such as 3). The interior of the central portion 50 and first leg 72 serve also to hold and restrain movement of the portions of the retainer 21 which do not extend rearwardly and outwardly from the central portion 50 through its opening 56 or 56A. FIGS. 10 and 12 show the retainer 21 in its relatively unextended and undeflected position relative to the interiors of the central portion 50 and first leg 72. FIG. 11 shows the retainer 21 in its extended position 21' and FIG. 13 shows the retainer 21 in its deflected position 21" relative to the interiors of the first leg 72 and the central portion 50.

As seen from FIGS. 10–13, the interior of the first leg 72 contains an elongated cavity 76 which contains an elongated serpentine, preferably horizontally serpentine, second end part 90, of the retainer 21. Preferably, the cavity 76 and the second end part 90 of the retainer 21 are both elongated in a direction along the length of the leg 72, i.e., parallel to the first and second sides 52 and 54 of the central portion 50. It is also preferred that the cavity 76 be open at the rear side of the corner assembly 11, preferably along substantially the entire length of the cavity 76, to allow the elongated second end part 90 of the retainer 21 to be easily inserted therein with its hook-shaped end part 22 extending outwardly of the opening 56 in the central portion 50. The crests 92 and 94 on opposite sides of the serpentine second end part 90 of the retainer 21 resiliently engage the front and rear walls 78 and 79 of the cavity 76 to frictionally restrain movement of the serpentine second end part 90 of the retainer 21 within the cavity 76. The serpentine configuration of the second end part 90 also serves to keep the retainer 21 from twisting in the cavity 76 so that its Look-shaped end part 22 stays in proper orientation for engaging a window frame 29.

As also seen from FIGS. 10–13, the cavity 76 in the first leg 72 is connected, through a rearwardly extending channel 57 in the central portion 50 of the corner assembly 11, to the opening 56 at the rear side 54 of the central portion 50. Preferably, the channel 57 in the central portion 50 is also open at one side of the corner assembly 11 to allow a central part 96 of the retainer 21 to be easily inserted therein. The central part 96 of the retainer 21 extends through the channel 57 and the opening 56 and becomes thereby rearwardly curved. The curved central part 96 of the retainer 21, together with guiding surfaces on the edges of opening 56, ensure that the hook-shaped end part 22 of the retainer 21 is readily movable towards and away from the rear side 54 of the central portion 50 of the corner assembly 11 along a curved path. The structure described above regarding: i) the elongated serpentine second end part 90 of the retainer 21, within the elongated cavity 76 of the first leg 72, ii) the curved central part 96 of th retainer, within the channel 57 and the opening 56 in the rear side 54 of the central portion 50, and iii) the hook-shaped end part 22 outside and rearward of the rear side 52 of the central portion 50 of the corner assembly 11 are typical of all the corner assemblies 11, 13, 15 and 17 of the perimeter frame 1 of this invention.

FIGS. 12 and 13 show one of the upper corner assemblies 11 and in particular show that, in its first leg 72, the end of the cavity 76 remote from the central portion 50 is relatively narrow in the vertical plane, but the cavity 76 gradually widens vertically towards its other end, as it joins the channel 57. Likewise, the channel 57 gradually widens vertically as it goes from its end in communication with the cavity 76 to the opening 56 in the rear side 54 of the central portion 50. This profile of the cavity 76 allows relatively resilient deflection of the retainer 21 outside of the corner assembly 11 (as shown in FIG. 8). In FIG. 13, the retainer 21 is shown in its deflected position 21", but normally, the retainer will not stay in the deflected position 21" shown in FIG. 13 but will, in fact, be resiliently biased towards its undeflected position as shown in FIG. 12. In the perimeter frame 1, the other upper corner assembly 17 will also have this structure for its cavity 76 and channel 57. However in the lower corner assemblies 13 and 15, each cavity 76 and channel 57 are preferably of constant width vertically and do not widen gradually as they go towards the opening 66, which is vertically smaller than the corresponding opening 56 in the upper corner assemblies.

FIGS. 14–16 show another embodiment of a corner assembly 115 of the invention which is similar to the corner assembly 15 of FIGS. 1–13 and for which the same reference numerals or corresponding reference numerals (greater by 100) are used below for describing the same parts or corresponding parts, respectively.

The corner assembly 115 has a central portion 160 connected to a pair of perpendicular legs 72 and 74 (hidden from view) inserted in adjacent frame members 107 and 109 of a perimeter frame of this invention. The rear side 164 of the central portion 160 has rectangular openings 166 and 166A, from one of which 166 a retainer 125 extends rearwardly. The retainer 125 is generally rearwardly curved and arc-shaped and includes: a hook-shaped end part 126; an elongate other end part 190 within a cavity 76 (not shown) within the first leg 72 (hidden from view), and a central part 196. The retainer 125 also has a rectangular cross-section that is wider than it is thick to give the retainer enhanced torsional stability. Preferably, the rectangular cross-section of the elongate end part 190 and central part 196 of the retainer 125 conforms closely to the rectangular cross-sections of the opening 166 and 166A and the cavity 76, so that there is a close fit of the retainer in the cavity and openings to keep the retainer from twisting and so that its hook-shaped end part 126 stays in proper orientation for engaging a window frame.

The central part 196 of the retainer 125 has saw tooth serrations 197 on its upper surface for engagement with a worm screw member 145 mounted on the rear side 164 of the central portion 160. The openings 166 and 166A, prior to use, can be closed by a break-through wall portion which then can be selectively removed depending on the opening 166 and 166A, through which the retainer 125 is to extend. Only the opening 166 and 166A, from which the retainer 125 is to extend, then needs to be removed, and the exterior surface of the corner assembly 115 can thereby retain a generally smooth and closed appearance.

In FIG. 15, two positions of the retainer 125 are shown. In a first position 125', the hook-shaped end part 126' of the retainer is at a distance "c" from the rear side 164 of the central portion 160. A suitable minimum distance "c" for the first position 125' could be about 5 mm. In a second position 125", the hook-shaped end part 126" of the retainer 125'" is at a distance "d" from the rear side 164 of the central portion 160. A suitable maximum distance "d" for the second position 125" would be about 20 mm or more.

FIG. 15 also shows schematically the arc-shaped other end part 190 and central part 196 of the retainer 125, which enable the retainer to move through an arc shaped path, so that its movement between position 125' and position 125" corresponds to an angular track $\alpha$.

FIG. 16 shows a preferred worm screw 145A that is snap-fit in a cavity 146 in the rear side 164 of the central portion 160 in a direction generally indicated by arrow 147. The worm screw 145A is provided with a bifurcated end 148, resiliently carrying detent surfaces 149 which can engage corresponding detent surfaces 149A within the cavity 146 of the central portion 160. To engage the saw tooth serrations 197 on the top surface of the retainer 125, the worm screw 145A is provided with a helical thread 198.

Once the worm screw 145 or 145A is mounted in the central portion 160, it can be freely rotated in both directions to adjust the retainer 125 inwardly and outwardly of the central portion 160 through engagement of the saw tooth serrations 197. In this regard, a hook-shaped end part 126 of the retainer 125 extends outwardly of the aperture 166. By means of the worm screw 145, the retainer 125 can be moved inwardly and outwardly of the aperture 166, whereby its elongated, rearwardly curved, second end part 190 and its rearwardly-curved central part 196 can be moved inwardly and outwardly of the elongate cavity 76 within the first leg 72 and the connecting channel 57 within the central portion 160.

As seen in FIG. 14, the worm screw 145 is provided with a conventional head portion 199, by which it can be rotated. In this regard, the head portion 199 is provided with a recessed slot 200 for engagement by a screw driver or the like.

FIGS. 17–19 show a further embodiment of a perimeter frame 201 which is similar to the perimeter frame 1 of FIGS.

1–13 and for which the same reference numerals or corresponding reference numerals (greater by 200) are used below for describing the same parts or corresponding parts, respectively. The perimeter frame 201 includes four corner assemblies 211, 213, 215 and 217 of the invention which are similar to the corner assembly 115 of FIGS. 14–16 and for one of which 213 the same reference numerals or corresponding reference numerals (greater by 100) are used below for describing the same parts or corresponding parts, respectively. In this regard, the corner assembly 213 has a central portion 260 connected to a pair of perpendicular legs 72 and 74 (hidden from view) inserted in adjacent frame members 205 and 207 of the perimeter frame 201.

The perimeter frame 201 is preferably provided with hand grips 202 which facilitate the manipulation of the perimeter frame when fitting it into a window opening frame 30 (not shown). The hand grips 202 can thereby also help to prevent damage to its screen-like panel 219. These hand grips or other similar handles are aLso preferably included in any of the embodiments to facilitate installation.

The corner assembly 213 is provided with two apertures 266 and 266A in the rear side 264 of its central portion 260. A hook-shaped end part 224 of a retainer 223 extends outwardly of the aperture 266. By means of a worm screw 245 on the rear side 264 of the central portion 260, the retainer 223 can be moved inwardly and cutwardly of the aperture 266, whereby its elongate second end part 290 and its rearwardly-curved central part 296 can be moved inwardly and outwardly of the elongate cavity 76 (not shown) within the first leg 72 and the connecting channel 57 within the central portion 260. A like arrangement can be seen on the other corner assemblies 211, 215 and 217.

FIG. 18 shows the worm screw 245 and the retainer 223 free from the surrounding structure of the corner assembly 213. In this embodiment, a helical screw thread 298 engages a segment of gear teeth 297 on the outwardly curved edge of the arc-shaped central portion 296 of the retainer 223. It is also seen that in this embodiment, the worm screw 245 has a first screw driver slot 300 in its head portion 299 and a second screw driver slot 300A at its opposite axial end.

Each of the screw driver slots 300 and 300A is engageable from a respective opposite side of the screen-like panel 219 so that adjustments can be made from inside and outside the building and the window opening, to which the screen panel 219 has been fitted.

For embodiments having worm screws or other similar mechanisms for extending and retracting the hooks, it is possible to locate the operating feature, for instance the screw driver slot, on either side of the perimeter frame relative to extension of the hook. However, where perimeter frames are hung on the outside of windows, the operating feature preferably faces inwardly where they can be operated to retract the retainers so as to hold the perimeter frames securely on the outside of the windows. Of course, the operating features, eg the worm screws, could also be mounted so that their head portions could be reached from the outside of the perimeter frames that are to be held on the inside of the windows.

FIG. 19 shows the worm screw 245 and the retainer 223 from the bottom rear of the corner assembly 213. A reference "x" denotes the distance between the hook-shaped end 224 of the retainer 223 from the rear side 264 of the corner assembly 213.

The invention as embodied in FIGS. 14 to 19 can be combined with that as embodied in FIGS. 1–13. In particular, it is possible to combine the use of the spring steel hooks of FIGS. 1 to 13 with an operating mechanism, such as the worm screws of FIGS. 14 to 19. As one example, the spring steel hooks can each be mounted on one end of an elongated spring steel central part (like the central part 96 of FIGS. 10 to 13) which, in turn, is connected to a curved toothed plastic member like the central part 196, 296 of FIGS. 14 to 19. In this way, a worm screw can engage the toothed plastic member so as to extend and retract the spring steel hook. As another example, a spring steel member could itself be formed with means to engage some operating feature. For instance, the spring steel member could itself include teeth for engagement with a worm screw or, indeed, the serpentine section of FIGS. 10 to 13 could itself be engaged by a worm screw to affect extension and retraction of the hook.

The perimeter frames 1 and 201 of this invention not only improve the positioning of a screen-like panel 19 and 219 in a window opening 30 but also hold such a screen-like panel in position without any play on a variety of window opening edges. This allows for easy mounting and adjustment of a screen-like panel with simple and cost-effective methods and tools. A particular advantage of the corner assemblies 11, 13, 15, 17, 115, 211, 213, 215 and 217 of these perimeter frames is that they can be used in prefabricated window systems, in which drilling of holes is not permitted. Another advantage is that the screen-like panel can be left in position while the window is closed. In this regard, the windows described with respect to FIGS. 2–7 usually are provided with a hinged pane opening towards the inside of a building, but in certain countries, there is a preference for windows opening to the outside of a building which may result in an inverse arrangement of parts of the corner assemblies of this invention but which should otherwise be considered to be within the scope of the invention.

This invention is, of course, not limited to the above-described embodiments which may be modified without departing from the scope of the invention or sacrificing all of its advantages. In this regard, the terms in the foregoing description and the following claims, such as "upper", "lower", "front", "rear", "inner", "outer", "horizontal", "vertical", "central" and "end", have been used only as relative terms to describe the relationships of the various elements of the corner assemblies of the invention.

What is claimed is:

1. A nodal assembly for connecting at least two adjacent frame members of a perimeter frame, the nodal assembly comprising:

a central portion having parallel first and second sides and an opening in an outer face of the second side;

a first leg extending from the central portion in a first direction parallel to the first side and having a cavity within it in communication with the opening;

a second leg extending from the central portion in a second direction different from the first direction but also parallel to the first side; and a retainer slidably received in the cavity and movable between a retracted position substantially within the central portion and the first leg and an extended position in which the retainer extends substantially outwardly of the opening in the second side of the central portion and away from the outer face of the second side.

2. The nodal assembly of claim 1 wherein the retainer comprises:

an elongated part at one end, which is slidably received in the cavity in the first leg and in a channel in the central portion, and which can be moved outwardly of the second side of the central portion through the opening in the second side; and a hook-shaped part at its other end, which is located outwardly of the second side of the central portion; the retainer, in its retracted position, having a central part substantially within the cavity in the first leg and, in its extended position, having its central part extending outwardly of the cavity through the opening in the central portion and away from the second side of the central portion.

3. The nodal assembly of claim 1 wherein the retainer comprises:

an elongated front end part, which is slidably received in the cavity in the first leg and which can be moved rearwardly of the second side of the central portion through the opening in the second side; and a hook-shaped rear end part, which is located rearwardly of the second side of the central portion; the retainer, in its retracted position, having a central part substantially within the cavity in the first leg and, in its extended position, having its central part extending outwardly of the cavity through the opening in the central portion and rearwardly of the second side of the central portion.

4. The nodal assembly of claim 2, or 3, wherein said cavity in said first leg has a first longitudinal end and a second longitudinal end, said second longitudinal end being in communication with said channel in said central portion, and said first longitudinal end being open to permit said retainer to freely move within said cavity with sliding movement of said retainer between said retracted position and said extended position.

5. The nodal assembly of claim 2 or 3 wherein the central part of the retainer is rearwardly curved.

6. The nodal assembly of claim 5 wherein the elongated end part and the central part of the retainer are arc-shaped and rearwardly curved and have a rectangle cross-section that is wider than it is thick.

7. The nodal assembly of claim 1 wherein the first and second sides of the central portion are laterally opposite, front and rear sides; the cavity is substantially parallel to the first leg; one end of the cavity is in communication with one end of a channel in the central portion; and the other end of the channel is in communication with the opening in the second side of the central portion.

8. The nodal assembly of claim 7 wherein the channel gradually widens in the vertical plane as it goes from its one end in communication with the cavity to its other end in communication with the opening in the second side of the central portion.

9. The nodal assembly of claim 7 or 8, wherein said cavity in said first leg has a first end opposite its said one end, said first end being open to permit said retainer to freely move within said cavity with sliding movement of said retainer between said retracted position and said extended position.

10. The nodal assembly of claim 1 wherein the retainer is made of a spring steel.

11. The nodal assembly of claim 1 wherein the retainer comprises an elongated second end part that has a serpentine shape and that is slidably received in the cavity in the first leg.

12. The nodal assembly of claim 11 wherein the elongated second end part has a horizontally serpentine shape.

13. The nodal assembly of claim 11 or 12 wherein crests on opposite sides of the elongated second end part of the retainer resiliently engage walls of the cavity to frictionally restrain movement of the elongated second end part of the retainer within the cavity.

14. The nodal assembly of claim 11, 12, or 10, wherein said cavity in said first leg has a first longitudinal end and a second longitudinal end, said second longitudinal end being in communication with a channel in said central portion, and said first longitudinal end being open to permit said retainer to freely move within said cavity with sliding movement of said retainer between said retracted position and said extended position.

15. The nodal assembly of claim 1 wherein the cavity has a first end, remote from the central portion, and a second end, adjacent to the central portion, and wherein the cavity is relatively narrow in the vertical plane at the first end and gradually widens towards the second end.

16. The nodal assembly of claim 15, wherein said first end of said cavity is open to permit said retainer to freely move within said cavity with sliding movement of said retainer between said retracted position and said extended position, and said second end of said cavity is in communication with a channel in said central portion.

17. A perimeter frame comprising:

a plurality of elongate frame members;

a plurality of nodal assemblies, each nodal assembly for connecting together at least two of the elongated frame members, wherein each nodal assembly comprises a central portion having parallel first and second sides and an opening in an outer face of the second side;

a first leg extending from the central portion in a first direction parallel to the first side and having a cavity within it in communication with the opening;

a second leg extending from the central portion in a second direction different from the first direction but also parallel to the first side, wherein the first and second legs engage the ends of two adjacent frame members to form the perimeter frame; and a retainer slidably received in the cavity and movable between a retracted position substantially within the central portion and the first leg and an extended position in which the retainer extends substantially outwardly of the opening in the second side of the central portion and away from the outer face of the second side.

18. The frame of claim 17 further comprising a sheet-like panel attached to the perimeter frame to cover an area defined by the perimeter frame; each of the retainers being adapted to engage a window opening having a polygonal contour corresponding to the perimeter frame so that the sheet-like panel covers the window opening.

19. The frame of claim 17 or 18 wherein an upper nodal assembly includes a retainer made of a relatively flexible material and a lower nodal assembly includes a retainer made of a relatively inflexible material.

20. A nodal assembly for connecting at least two adjacent frame members of a perimeter frame, the nodal assembly comprising:

a central portion having parallel first and second sides and an opening in the second side;

a first leg extending from the central portion in a first direction parallel to the first side and having a cavity within it in communication with the opening;

a second leg extending from the central portion in a second direction different from the first direction but also parallel to the first side; and a retainer slidably received in the cavity and movable between a retracted position substantially within the central portion and the first leg, and an extended position in which the retainer extends substantially outwardly of the opening in the second side of the central portion and away from the second side, the retainer comprising:

an elongated second end part, which is slidably received in the cavity in the first leg and in a channel in the central portion, and which can be moved outwardly of the second side of the central portion through the opening in the second side;

a hook-shaped first end part, which is located outwardly of the second side of the central portion; and a central part having a surface with serrations thereon, wherein a worm screw is mounted on the central portion and has threads that engage the serrations, and wherein when the retainer is in its retracted position the central part is substantially within the cavity in the first leg, and when the retainer is in its extended position the central part extends outwardly of the cavity through the opening in the central portion and away from the second side of the central portion, and further wherein the elongated second end part and the central part of the retainer are arcshaped and rearwardly curved and have a rectangular cross-section that is wider than it is thick.

21. The nodal assembly of claim 20 wherein the first and second sides of the central portion are laterally opposite, front and rear side; the cavity is substantially parallel to the first leg; one end of the cavity is in communication with one end of said channel in the central portion; and the other end of said channel is in communication with the opening in the second side of the central portion.

22. The nodal assembly of claim 21 wherein the channel gradually widens in the vertical plane as it goes from its one end in communication with the cavity to its other end in communication with the opening in the second side of the central portion.

23. The nodal assembly of claim 20 wherein said elongated second end part has a serpentine shape.

24. The nodal assembly of claim 23 wherein the elongated second end part has a horizontally serpentine shape.

25. The nodal assembly of claim 23 or 24 wherein crests on opposite sides of the elongated second end part of the retainer resiliently engage walls of the cavity to frictionally restrain movement of the elongated second end part of the retainer within the cavity.

26. The nodal assembly of claim 20 wherein the retainer is made of a spring steel.

27. The nodal assembly of claim 20 wherein the cavity has a first end, remote from the central portion, and a second end, adjacent to the central portion, and wherein the cavity is relatively narrow in the vertical plane the first end and gradually widens towards the second end.

28. A perimeter frame comprising:

a plurality of elongate frame members;

a plurality of nodal assemblies, each nodal assembly for connecting together at least two of the elongated frame members, wherein each nodal assembly comprises a central portion having parallel first and second sides and an opening in the second side;

a first leg extending from the central portion in a first direction parallel to the first side and having a cavity within it in communication with the opening;

a second leg extending from the central portion in a second direction different from the first direction but also parallel to the first side, wherein the first and second legs engage the ends of two adjacent frame members to form the perimeter frame; and a retainer slidably received in the cavity and movable between a retracted position substantially within the central portion and the first leg, and an extended position in which the retainer extends substantially outwardly of the opening in the second side of the central portion and away from the second side, the retainer comprising:

an elongated second end part, which is slidably received in the cavity in the first leg and in a channel in the central portion, and which can be moved outwardly of the second side of the central portion through the opening in the second side;

a hook-shaped first end part, which is located outwardly of the second side of the central portion; and a central part having a surface with serrations thereon, wherein a worm screw is mounted on the central portion and has threads that engage the serrations, and wherein when the retainer is in its retracted position the central part is substantially within the cavity in the first leg, and when the retainer is in its extended position the central part extends outwardly of the cavity through the opening in the central portion and away from the second side of the central portion, and further wherein the elongated second end part and the central part of the retainer are arc-shaped and rearwardly curved and have a rectangular cross-section that is wider than it is thick.

* * * * *